US007227315B2

(12) United States Patent
Shinbo et al.

(10) Patent No.: US 7,227,315 B2
(45) Date of Patent: Jun. 5, 2007

(54) DISCHARGE LAMP DRIVE APPARATUS AND LIQUID CRYSTAL DISPLAY APPARATUS

(75) Inventors: Satoshi Shinbo, Tokyo (JP); Hiroshi Maeda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/345,487

(22) Filed: Feb. 2, 2006

(65) Prior Publication Data

US 2006/0175989 A1 Aug. 10, 2006

(30) Foreign Application Priority Data

Feb. 10, 2005 (JP) ..... 2005-034955

(51) Int. Cl.
*H05B 37/00* (2006.01)

(52) U.S. Cl. ..... 315/224; 315/219; 315/239; 315/312

(58) Field of Classification Search ..... 315/224, 315/225, 312, 240, 219, 276, 239
See application file for complete search history.

(56) References Cited

U.S. PATENT DOCUMENTS 5,331,253 A * 7/1994 Counts ..... 315/209 R
6,362,575 B1 * 3/2002 Chang et al. ..... 315/224

FOREIGN PATENT DOCUMENTS

| | | |
|---|---|---|
| JP | 3-21038 | 5/1991 |
| JP | 4-79120 | 12/1992 |
| JP | 6-267674 | 9/1994 |
| JP | 9-322553 | 12/1997 |
| JP | 2000-3796 | 1/2000 |
| JP | 2002-164185 | 6/2002 |
| JP | 2004-241136 | 8/2004 |

OTHER PUBLICATIONS

U.S. Appl. No. 11/258,899, filed Oct. 27, 2005, Maeda et al.
U.S. Appl. No. 11/258,908, filed Oct. 27, 2005, Maeda et al.
U.S. Appl. No. 11/345,487, filed Feb. 2, 2006, Shinbo et al.

* cited by examiner

*Primary Examiner*—David Vu
(74) *Attorney, Agent, or Firm*—Oblon, Spivak, McClelland, Maier & Neustadt, P.C.

(57) ABSTRACT

A discharge lamp drive apparatus includes: an inverter circuit; a transformer; a plurality of discharge lamp connection terminals; a plurality of ballast capacitors; a plurality of voltage detection circuits; and a signal processor. Each voltage detection circuit has first and second voltage detection elements constituting a series circuit. Each series circuit has a first end connected with a corresponding one of the discharge lamp connection terminals and a second end connected with a grounding terminal. The signal processor generates a signal indicating an open state of a discharge lamp by using an average value and a peak value of voltages appearing between connection points of the first and second voltage detection elements and the grounding terminals.

8 Claims, 9 Drawing Sheets

DISCHARGE LAMP DRIVE APPARATUS AND LIQUID CRYSTAL DISPLAY APPARATUS

BACKGROUND OF THE INVENTION

1. Field of the Invention

The present invention relates to a discharge lamp drive apparatus which drives discharge lamps used as a backlight for a liquid crystal panel, and a liquid crystal display apparatus using the same.

2. Description of the Related Art

In recent years, with an increase in size of a screen of a liquid crystal panel, a circuit scheme which drives a plurality of discharge lamps for a backlight in parallel has been used in one liquid crystal panel. As means for driving the plurality of discharge lamps in parallel, there are a scheme which connects one end side of the plurality of discharge lamps with an inverter circuit and a transformer and grounding the other end side of the same (which will be referred to as a normal drive scheme hereinafter) and a scheme which connects one end side of the plurality of discharge lamps with an inverter circuit and a transformer and connects the other end side of the same with another transformer (which will be referred to as a differential drive scheme hereinafter).

Of these two schemes, the differential drive scheme can reduce output voltages of the transformers, which enables the use of circuit components having a small withstand voltage, thereby decreasing a cost accordingly.

In such a discharge lamp drive apparatus, however, there occurs a state in which a current does not flow between a transformer and discharge lamps (which will be referred to as an open state hereinafter) in some cases because of, e.g., a contact failure of a discharge lamp electrode with respect to a connector. Such an abnormal state, in which a liquid crystal display cannot operate appropriately, must be detected. As such means, for example, Japanese Patent Application Publication No. 6-267674 and Japanese Patent Application Publication No. 2004-241136 disclose a normal drive type discharge lamp drive apparatus which is provided with a light-off detection circuit for detecting the open state.

In the discharge lamp drive apparatus disclosed in JP 6-267674 and JP 2004-241136, since the normal drive scheme is adopted, one end side of discharge lamps is grounded and has a low voltage. Therefore, whether each discharge lamp is in the open state or not can be determined by providing a resistance between the end side of the respective discharge lamps and the ground and detecting a current flowing through the resistance.

However, in case of a discharge lamp drive apparatus adopting the differential drive scheme, since transformers are connected with both ends of the discharge lamps and both the ends of the discharge lamps have a high voltage, it is impossible to take such a circuit configuration as disclosed in JP 6-267674 and JP 2004-241136 in which the resistance is provided between the discharge lamps and the ground.

On the other hand, adopting current transformers or the like to detect a current flowing through each end of the discharge lamps, which has a high voltage, presents the problem of hindering size reduction and cost reduction of the product.

SUMMARY OF THE INVENTION

It is an object of the present invention to provide a discharge lamp drive apparatus which can detect that at least one of a plurality of discharge lamps is in an open state, and a liquid crystal display apparatus using the same.

It is another object of the present invention to provide a discharge lamp drive apparatus which can be reduced in size, and a liquid crystal display apparatus using the same.

It is still another object of the present invention to provide a discharge lamp drive apparatus which can be reduced in cost, and a liquid crystal display apparatus using the same.

To achieve the above-mentioned objects, a discharge lamp drive apparatus according to the present invention comprises: an inverter circuit; a transformer; a plurality of discharge lamp connection terminals; a plurality of ballast capacitors; a plurality of voltage detection circuits; and a signal processor. The inverter circuit converts a direct-current voltage into an alternating voltage and outputs the converted voltage. The transformer receives the alternating voltage from the inverter circuit at an input winding thereof and outputs an alternating voltage from an output winding thereof. The discharge lamp connection terminals are intended to be connected with a plurality of discharge lamps, respectively. Each ballast capacitor has a first electrode led to the output winding and a second electrode connected with a corresponding one of the discharge lamp connection terminals. Each voltage detection circuit has first and second voltage detection elements constituting a series circuit. Each series circuit has a first end connected with a corresponding one of the discharge lamp connection terminals and a second end connected with a grounding terminal. The signal processor generates a signal indicating an open state of a discharge lamp by using an average value and a peak value of voltages appearing between connection points of the first and second voltage detection elements and the grounding terminals.

The above-described discharge lamp drive apparatus according to the present invention may be combined with a plurality of discharge lamps and a liquid crystal panel to constitute a liquid crystal display apparatus. The discharge lamps have electrodes connected with the discharge lamp connection terminals, respectively. The liquid crystal panel is disposed in front of the discharge lamps.

In the above-described liquid crystal display apparatus, the discharge lamps are driven and turned on by the alternating voltage output from the output winding of the transformer. Since the liquid crystal panel is disposed in front of the discharge lamps, the discharge lamps function as a backlight for the liquid crystal panel.

In the liquid crystal display apparatus according to the present invention, the first and second voltage detection elements of each voltage detection circuit constitute a series circuit. Each series circuit has a first end connected with a corresponding one of the discharge lamp connection terminals and a second end connected with a grounding terminal.

In this configuration, when at least one of the plurality of discharge lamps enters an open state, a voltage which can be substantially considered as an open voltage is generated at one discharge lamp connection terminal in an open state. This voltage has a higher value than voltages appearing at the other discharge lamp connection terminals in a normal connection state. Accordingly, a voltage appearing in the voltage detection circuit connected with the discharge lamp connection terminal in an open state has a higher value than voltages appearing in the voltage detection circuits connected with the discharge lamp connection terminals in a normal connection state.

Hence, the signal processor can generate a signal indicating an open state of a discharge lamp by using an average value and a peak value of voltages appearing between connection points of the first and second voltage detection elements and the grounding terminals, thereby detecting that at least one of the plurality of discharge lamps is in an open state.

The generated signal indicating an open state of a discharge lamp may be adopted for various purposes. For instance, the signal indicating an open state of a discharge lamp may be used to restrict the operation of the inverter circuit or may be used just to indicate the open state.

Since the liquid crystal display apparatus according to the present invention detects a voltage rather than a current, the first and second voltage detection elements, e.g., capacitors may be adopted to achieve size reduction and cost reduction of the product.

As has been described hereinabove, the present invention has at least one of the following advantages:

(a) Providing a discharge lamp drive apparatus which can detect that at least one of a plurality of discharge lamps is in an open state, and a liquid crystal display apparatus using the same;

(b) Providing a discharge lamp drive apparatus which can be reduced in size, and a liquid crystal display apparatus using the same; and (c) Providing a discharge lamp drive apparatus which can be reduced in cost, and a liquid crystal display apparatus using the same.

The present invention will be more fully understood from the detailed description given hereinbelow and the accompanying drawings which are given by way of illustration only, and thus are not to be considered as limiting the present invention.

DESCRIPTION OF THE PREFERRED EMBODIMENTS

Figure 1:
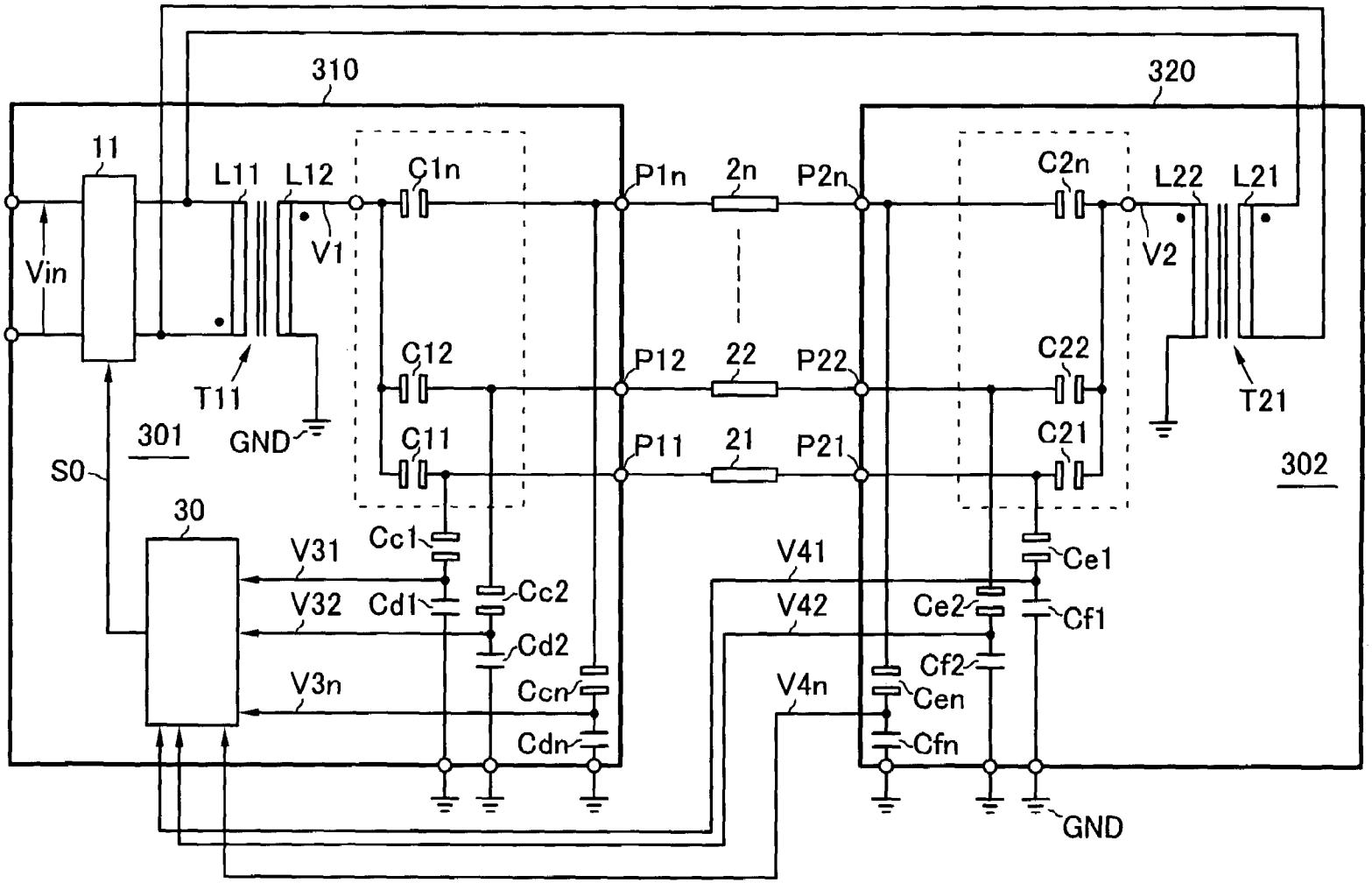
FIG. 1 is an electric circuit diagram showing a discharge lamp lighting apparatus incorporating a discharge lamp drive apparatus according to one embodiment of the present invention.

Referring to FIG. 1, a discharge lamp lighting apparatus may be used for a backlight device in, e.g., a liquid crystal TV, a monitor, or the like. The illustrated discharge lamp lighting apparatus adopts a differential drive scheme (or floating scheme), and includes a master unit 301, a slave unit 302, first and second ballast capacitors C11 to C1*n*, C21 to C2*n*, a plurality of voltage detection circuits, a signal processor 30, first and second substrates 310, 320, and discharge lamps 21 to 2*n*. A circuit section of the discharge lamp lighting apparatus, exclusive of the discharge lamps 21 to 2*n*, is designated as a discharge lamp drive apparatus, which can be traded separately from the discharge lamps 21 to 2*n*.

The master unit 301 includes an inverter circuit 11 and a first transformer T11. The inverter circuit 11 converts a direct-current voltage of a direct-current power supply Vin into an alternating voltage and outputs the converted voltage. The direct-current power supply Vin is generally obtained by converting a commercial alternating voltage into a direct-current voltage and then further converting this direct-current voltage by using a DC/DC converter.

The first transformer T11 includes an input winding L11 and an output winding L12. To the input winding L11, the inverter circuit 11 supplies the alternating voltage. The output winding L12 has a low-voltage side output end which is grounded and a high-voltage side output end from which a first alternating voltage V1 is output. The first alternating voltage V1 is an alternating high voltage which is, e.g., approximately 1,800 V.

The slave unit 302 includes a second transformer T21. The second transformer T21 includes an input winding L21 and an output winding L22. To the input winding L21, the inverter circuit 11 supplies the alternating voltage. The output winding L22 has a low-voltage side output end which is grounded and a high-voltage side output end from which a second alternating voltage V2 is output.

The second alternating voltage V2 is an alternating high voltage which is, e.g., approximately 1,800 V and has a phase difference of 180 degrees with respect to the first alternating voltage V1. Such a differential drive scheme can reduce output voltages of the transformers T11, T21, which enables the use of circuit components having a small withstand voltage, thereby decreasing a cost accordingly.

Although omitted in the drawings, it is desirable to perform constant current control by detecting a current flowing between the low-voltage side output end of the output winding L12 and the ground and a current flowing between the low-voltage side output end of the output winding L22 and the ground and then feeding back the detected current to the inverter circuit 11.

The first ballast capacitors C11 to C1*n* have first electrodes commonly connected with one another and led to the output winding L12 of the first transformer T11 and second electrodes connected with first discharge lamp connection terminals P11 to P1*n*, respectively. The first discharge lamp connection terminals P11 to P1*n* are intended to be connected with first electrodes of the discharge lamps 21 to 2*n*, respectively.

The second ballast capacitors C21 to C2*n* have first electrodes commonly connected with one another and led to the output winding L22 of the second transformer T21 and second electrodes connected with second discharge lamp connection terminals P21 to P2*n*, respectively. The second discharge lamp connection terminals P21 to P2*n* are intended to be connected with second electrodes of the discharge lamps 21 to 2*n*, respectively.

Although capacitances of the ballast capacitors C11 to C1*n*, C21 to C2*n* are basically set to an almost equal value, it is preferred that the capacitances are slightly different from one another based on a change in tube current between the discharge lamps.

The plurality of voltage detection circuits include first voltage detection elements Cc1 to Ccn, Ce1 to Cen and second voltage detection elements Cd1 to Cdn, Cf1 to Cfn. The first voltage detection elements Cc1 to Ccn, Ce1 to Cen and the second voltage detection elements Cd1 to Cdn, Cf1 to Cfn constitute series circuits.

In the illustrated series circuits, the first voltage detection element Cc1 has a first electrode connected with the first discharge lamp connection terminal P11. The second voltage detection element Cd1 has a first electrode connected with a second electrode of the first voltage detection element Cc1 and a second electrode connected with a grounding terminal. The term "grounding terminal" as used herein refers to a terminal to be connected with the ground (GND).

Likewise, the first voltage detection elements Cc2 to Ccn have first electrodes connected with the first discharge lamp connection terminals P12 to P1*n*; the second voltage detection elements Cd2 to Cdn have first electrodes connected with second electrodes of the first voltage detection elements Cc2 to Ccn and second electrodes connected with grounding terminals. In the illustrated embodiment, the first and second voltage detection elements Cc1 to Ccn, Cd1 to Cdn, Ce1 to Cen, and Cf1 to Cfn are capacitors, but may be replaced by resistances, inductors, etc.

Connecting the first voltage detection elements Cc1 to Ccn with the first discharge lamp connection terminals P11 to P1*n*, i.e., the electrodes of the ballast capacitors C11 to C1*n* which are not commonly connected with one another, is essential to detecting voltage. This is because if the first voltage detection elements Cc1 to Ccn were connected with the commonly connected electrodes of the ballast capacitors C11 to C1*n*, the first voltage detection elements Cc1 to Ccn would detect a voltage appearing at the output winding L12 of the first transformer T11, which makes it impossible to detect a voltage change due to an open state.

The relation between the second discharge lamp connection terminals P21 to P2*n* and the first voltage detection elements Ce1 to Cen and the relation between the first voltage detection elements Ce1 to Cen and the second voltage detection elements Cf1 to Cfn are the same as the relation between the first discharge lamp connection terminals P11 to P1*n* and the first voltage detection elements Cc1 to Ccn and the relation between the first voltage detection elements Cc1 to Ccn and the second voltage detection elements Cd1 to Cdn, respectively, so that detailed description will be omitted.

By using an average value and a peak value of voltages V31 to V3*n* and V41 to V4*n* appearing between connection points of the first voltage detection elements Cc1 to Ccn, Ce1 to Cen and the second voltage detection elements Cd1 to Cdn, Cf1 to Cfn and the grounding terminals, the signal processor 30 detects abnormality in any of the discharge lamps 21 to 2*n* and outputs a signal S0 indicating an open state. The signal processor 30 may be constituted by software, or by an IC, an electronic component, etc.

Figure 2:
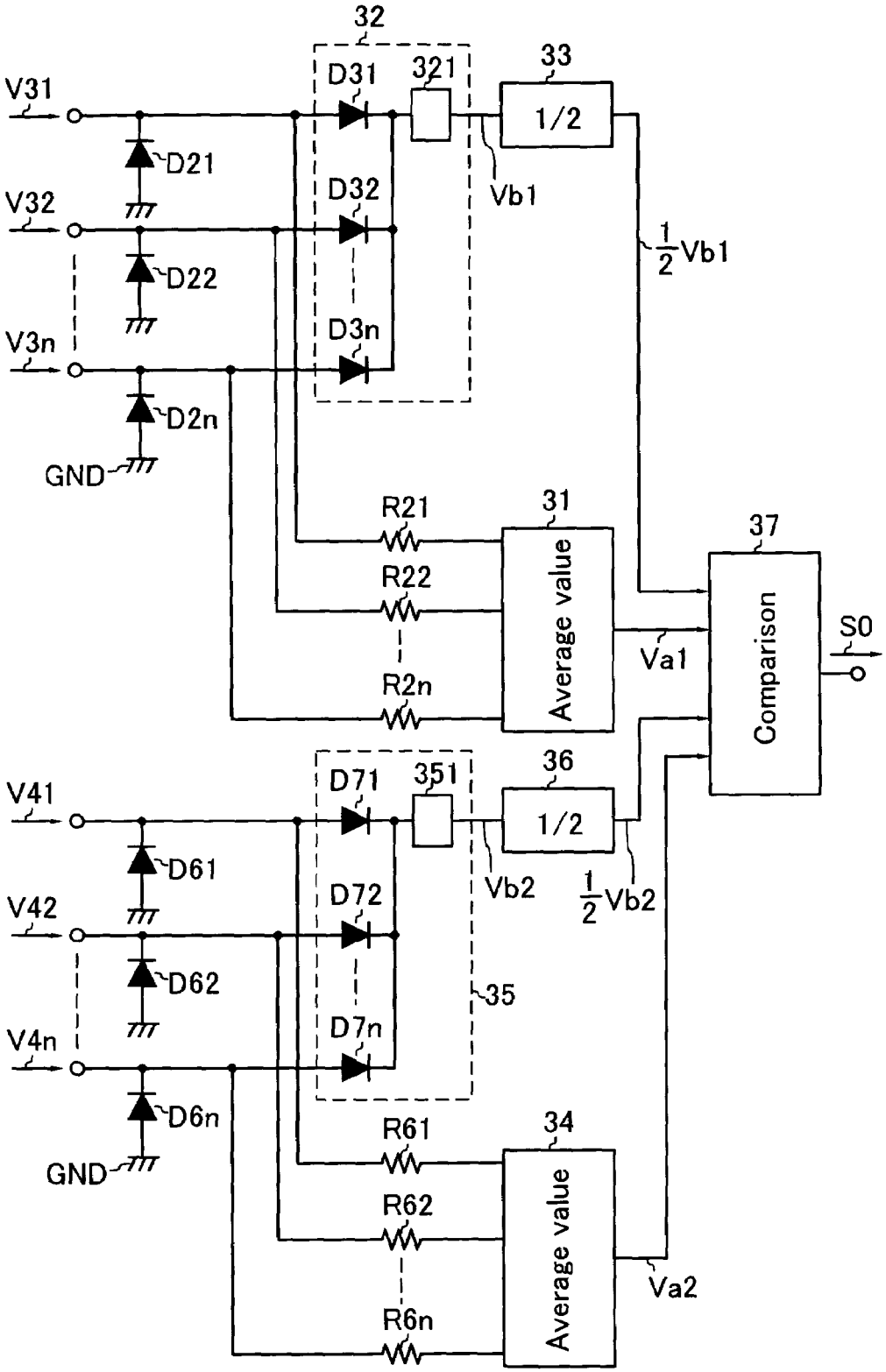
FIG. 2 is an electric circuit diagram showing a signal processor for use in a discharge lamp drive apparatus according to one embodiment of the present invention.

FIG. 2 is an electric circuit diagram showing one embodiment of the signal processor 30. In FIG. 2, the signal processor 30 has an average value circuit 31 which averages the individual voltages V31 to V3*n* to obtain an average value Va1. A peak detection circuit 32 detects a maximum peak value among the voltages V31 to V3*n* to hold a peak value Vb1 in a peak hold circuit 321. A multiplication circuit 33 multiplies the peak value Vb1 by the constant ½ to obtain (½)Vb1.

Likewise, an average value circuit 34 averages the individual voltages V41 to V4n to obtain an average value Va2. A peak detection circuit 35 detects a maximum peak value among the voltages V41 to V4*n* to hold a peak value Vb2 in a peak hold circuit 351. A multiplication circuit 36 multiplies the peak value Vb2 by the constant ½ to obtain (½)Vb2.

A comparison circuit 37 generates the signal S0 indicating an open state of a discharge lamp when the following inequality is satisfied:

$$Va1<(1/2)Vb1 \text{ or } Va2<(1/2)Vb2.$$

Referring again to FIG. 1, for instance, the discharge lamps 21 to 2*n* may be of a CCFL type such as cold cathode discharge lamps. The discharge lamps 21 to 2*n* are arranged in an array with their longitudinal directions parallel to each other. At longitudinally opposing ends, the discharge lamps 21 to 2*n* have the first and second electrodes.

The first electrodes of the discharge lamps 21 to 2*n* are led to the second electrodes of the first ballast capacitors C11 to C1*n* via the first discharge lamp connection terminals P11 to P1*n*. The second electrodes of the discharge lamps 21 to 2*n* are led to the second electrodes of the second ballast capacitors C21 to C2*n* via the second discharge lamp connection terminals P21 to P2*n*.

Figure 3:
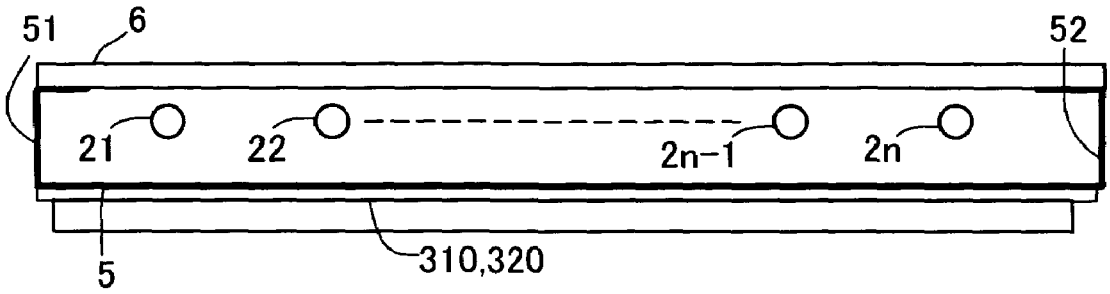
FIG. 3 is a partial cross-sectional view of a liquid crystal display apparatus incorporating the discharge lamp lighting apparatus shown in FIG. 1.

The discharge lamp lighting apparatus shown in FIG. 1 may be combined with a liquid crystal panel to constitute a liquid crystal display apparatus. FIG. 3 is a partial cross-sectional view of a liquid crystal display apparatus incorporating the discharge lamp lighting apparatus shown in FIG. 1.

In FIG. 3, the discharge lamps 21 to 2*n* are spaced apart and arranged in an array on one side of a rear plate 5. In front of the discharge lamps 21 to 2*n*, there is disposed a liquid crystal panel 6. The liquid crystal panel 6 is attached to raised portions 51, 52 which are raised around the rear plate 5. On the other side of the rear plate 5, there are attached the first and second substrates 310, 320 having the circuit configuration shown in FIG. 1.

Now the operation of the liquid crystal display apparatus shown in FIG. 3 will be described. When all the discharge lamps 21 to 2*n* are in a normal connection state (i.e., not in an open state), the first alternating voltage V1 is applied to the first electrodes of the discharge lamps 21 to 2*n*, while the second alternating voltage V2 is applied to the second electrodes of the discharge lamps 21 to 2*n*, thus turning on the discharge lamps 21 to 2*n*. Since the liquid crystal panel 6 is disposed in front of the discharge lamps 21 to 2*n*, the discharge lamps 21 to 2*n* function as a backlight for the liquid crystal panel 6.

In the discharge lamp drive apparatus shown in FIG. 1, the first voltage detection elements Cc1 to Ccn, Ce1 to Cen and the second voltage detection elements Cd1 to Cdn, Cf1 to Cfn constitute series circuits as the voltage detection circuits. The individual series circuits have first ends connected with the discharge lamp connection terminals P11 to P1*n*, P21 to P2*n* and second ends connected with the grounding terminals.

Figure 4:
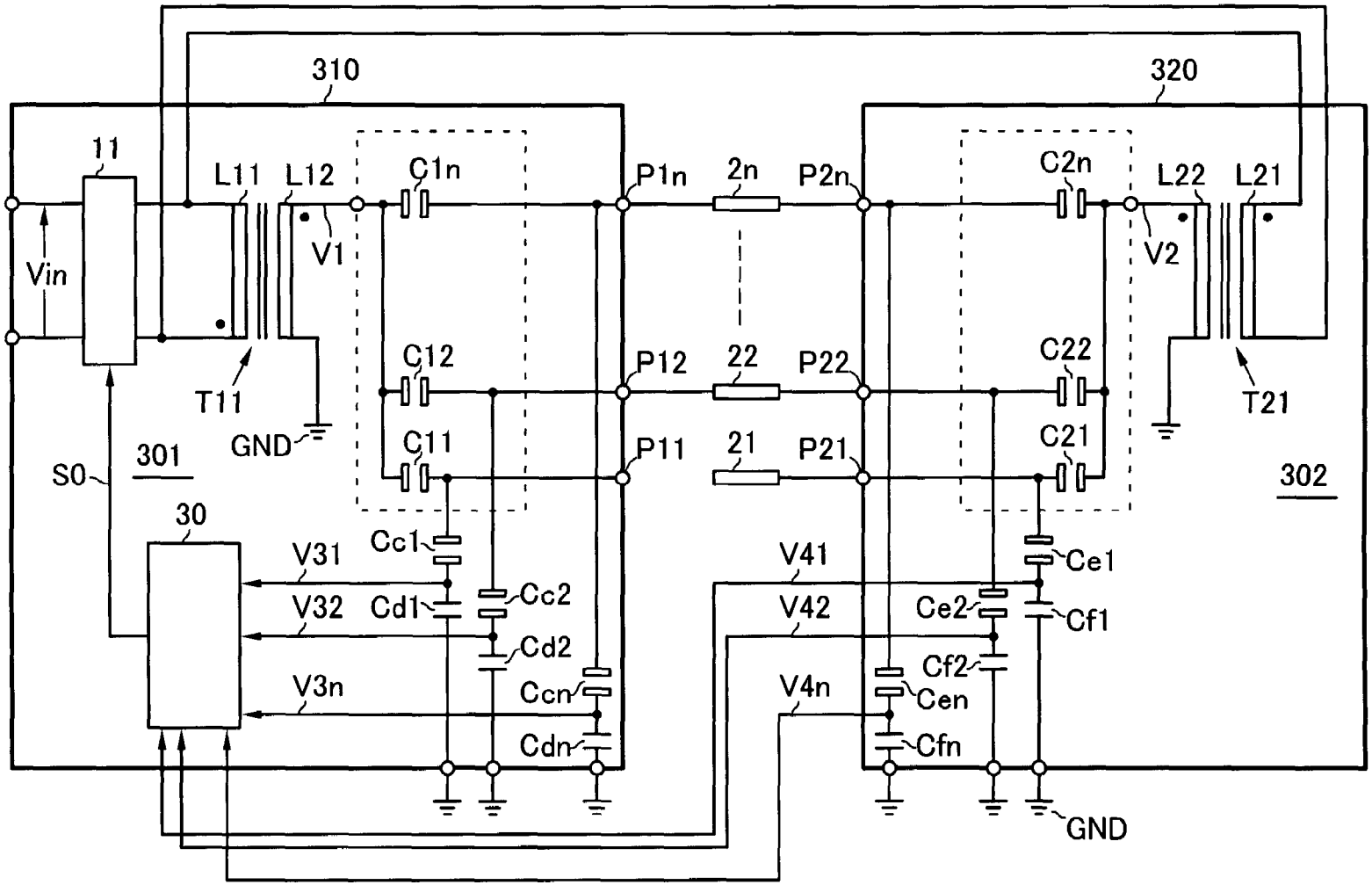
FIG. 4 is a diagram for explaining a case where one discharge lamp is in an open state in the discharge lamp lighting apparatus shown in FIG. 1.

With this configuration, for instance, when the discharge lamp 21 enters an open state on the side of the first discharge lamp connection terminal P11, as shown in FIG. 4, the voltage appearing at the first discharge lamp connection terminal P11 rises to an value which can be substantially considered as an open voltage, causing a remarkable change in the voltage V31 appearing at the connection point of the first voltage detection element Cc1 and the second voltage detection element Cd1.

On the other hand, since the voltages appearing at the discharge lamp connection terminals P12 to P1*n*, P21 to P2*n* hardly change, the voltages V32 to V3*n*, V41 to V4*n* also hardly change.

Thus, since the voltage V31 takes a value different from those of the voltages V32 to V3*n*, V41 to V4*n* due to the open state of the first discharge lamp connection terminal P11, the signal processor 30 can generate the signal S0 indicating an open state of an discharge lamp by using an average value and a peak value of the voltages V31 to V3*n*, V41 to V4*n*.

A similar explanation can be applied to cases where the discharge lamp connection terminals P12 to P1*n*, P21 to P2*n* enter an open state, but detailed description will be omitted.

How to calculate the average value and peak value will now be described. In the circuit configuration shown in FIGS. 1 and 2, the average value Va of the voltages V31 to V3*n* can be expressed by the following general equation:

$$Va=(SVP_{max}+SVP_{min})/2n-0.6(V) \quad (1)$$

where $SVP_{max}$ represents the sum of individual maximum peak values $VP_{max}$ of the voltages V31 to V3*n*, $SVP_{min}$ represents the sum of individual minimum peak values $VP_{min}$ of the voltages V31 to V3*n*, and n represents the number of the discharge lamps.

In the equation (1), −0.6 V represents the shift caused by diodes D21 to D2*n*.

On the other hand, (½)Vb can be expressed with respect to one of the voltages V31 to V3*n* whose waveform has the largest maximum peak value $VP_{max}$ by the following general equation:

$$(½)Vb=(VP_{max}-VP_{min})/2-0.6(V) \quad (2).$$

Figure 5:
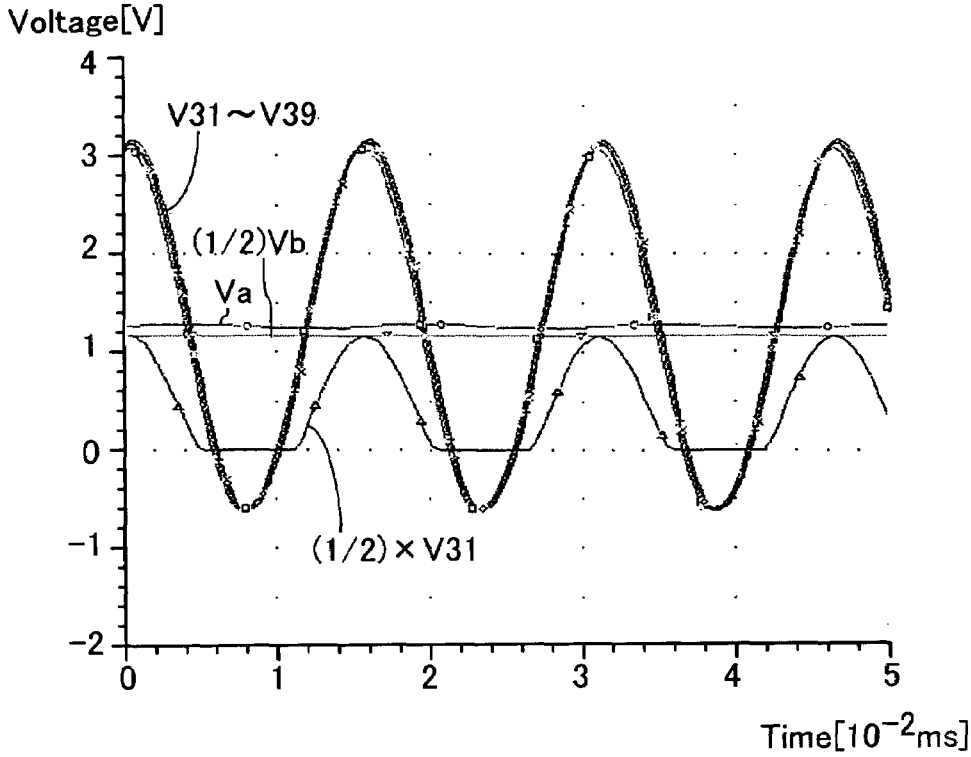
FIG. 5 is a characteristic diagram showing test data for the discharge lamp lighting apparatus shown in FIG. 1.
Figure 6:
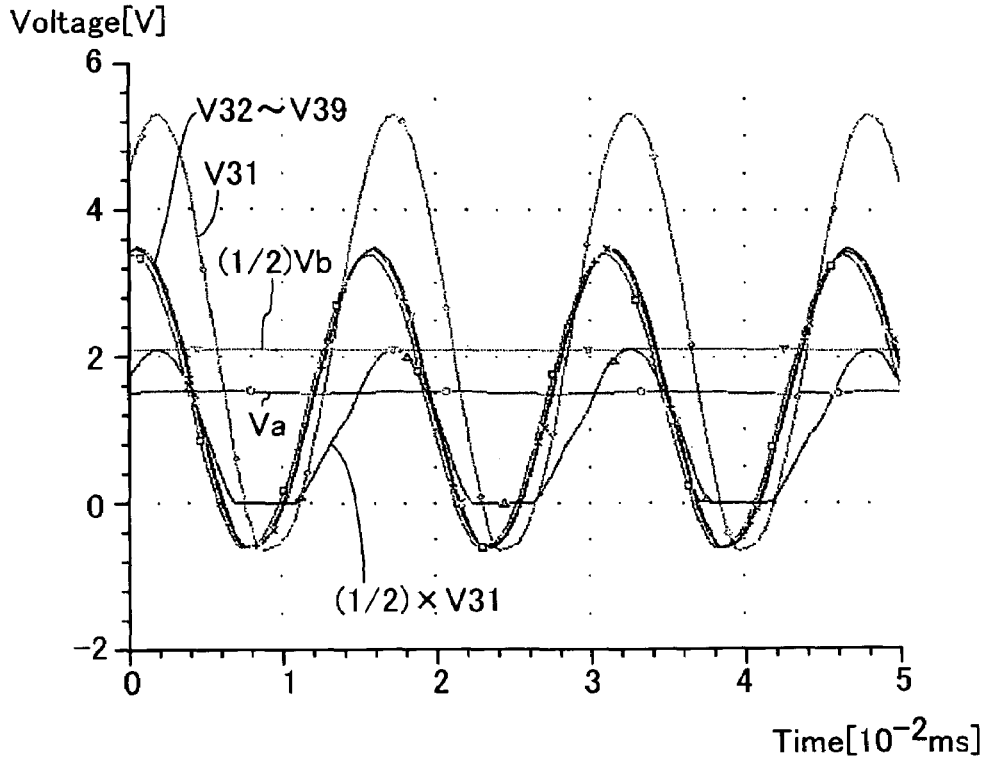
FIG. 6 is a characteristic diagram showing test data for the discharge lamp lighting apparatus shown in FIG. 4.

FIGS. 5 and 6 are characteristic diagrams showing test data for the discharge lamp lighting apparatus shown in FIG. 1, wherein n=9. More specifically, FIG. 5 is a characteristic diagram showing a case where all the discharge lamp connection terminals P11 to P19, P21 to P29 are in a normal connection state as in the discharge lamp drive apparatus shown in FIG. 1, while FIG. 6 is a characteristic diagram showing a case where the discharge lamp connection terminal P11 is in an open state as in the discharge lamp drive apparatus shown in FIG. 4. For the sake of clarity, the voltages V41 to V49 are not shown in FIGS. 5 and 6. In FIGS. 5 and 6, the minimum peak values are about −0.6 V under the influence of the diodes.

In FIG. 5, since all the discharge lamp connection terminals P11 to P19, P21 to P29 are in a normal connection state, the voltages V31 to V39 have almost identical waveforms. The waveforms of the voltages V31 to V39, which can be read from FIG. 5, have maximum peak values $VP_{max}$ of about 3.1 V and minimum peak values $VP_{min}$ of about −0.6 V.

Accordingly, when the maximum peak values $VP_{max}$ and the minimum peak values $VP_{min}$ are put into the equations (1) and (2), the average voltage Va and (½)Vb with respect to the voltages V31 to V39 can be obtained as follows:

$$Va = (3.1\times 9 + 0.6\times 9)/(2\times 9) - 0.6 = 1.25(\text{V}), \text{ and} \quad (3)$$

-continued $$(1/2)Vb = (3.1 + 0.6)/2 - 0.6 = 1.25(\text{V}). \quad (4)$$

As understood from the equations (3) and (4), when all the discharge lamps are in a normal connection state, there is obtained the following equation:

$$Va=(½)Vb.$$

Here, because the inequality Va<(½)Vb is not satisfied, the signal processor 30 does not generate the signal S0.

On the other hand, when the discharge lamp connection terminal P11 enters an open state, the voltage 31 appearing at the first discharge lamp connection terminal P11 rises to an value which can be substantially considered as an open voltage, as shown in FIG. 6. Therefore, the waveform of the voltage V31 becomes different from the waveforms of the voltages V32 to V39.

Referring to FIG. 6, the waveform of the voltage V31 has a maximum peak value $VP_{max}$ of about 5.2 V and a minimum peak value $VP_{min}$ of about −0.6 V. The waveforms of the voltages V32 to V39 have maximum peak values $VP_{max}$ of about 3.4 V and minimum peak values $VP_{min}$ of about −0.6 V.

When the maximum peak values $VP_{max}$ and the minimum peak values $VP_{min}$ are put into the equations (1) and (2), the average voltage Va and (½)Vb with respect to the voltages V31 to V39 can be obtained as follows:

$$Va = \{(5.2\times 1 + 3.4\times 8) + 0.6\times 9\}/(2\times 9) - 0.6 = 1.5(\text{V}), \text{ and} \quad (5)$$

$$(1/2)Vb = (5.2 + 0.6)/2 - 0.6 = 2.3(\text{V}). \quad (6)$$

As understood from the equations (5) and (6), when the discharge lamp connection terminal P11 is in an open state, the inequality Va=1.5(V)<(½)Vb=2.3(V) is satisfied, and therefore, the signal processor 30 generates the signal S0.

It should be noted that when the power is applied or the light emission amount of discharge lamps changes, for instance, since the currents supplied from the transformers T11, T21 change, the voltages at the discharge lamp connection terminals P11 to P1*n*, P21 to P2*n* also change uniformly. Accordingly, simply observing a voltage change at the discharge lamp connection terminals P11 to P1*n*, P21 to P2*n* is sometimes not enough to detect an open state of a discharge lamp.

However, the present invention has focused on the fact that a voltage appearing at one discharge lamp connection terminal in an open state changes noticeably as compared with voltages appearing at the other discharge lamp connection terminals. Comparing the peak value Vb, which will be greatly affected by a voltage change at the discharge lamp connection terminal in an open state, with the average value Va, which will be less affected by such a voltage change, assures detection of an open state of a discharge lamp.

Between FIGS. 5 and 6, for instance, while the peak value Vb changes noticeably due to the open state of the discharge lamp 21, the average value Va, which is affected more by the discharge lamps 22 to 29 than by the discharge lamp 21, does not change much.

The generated signal S0 may be adopted for various purposes. For instance, the signal may be used to restrict the operation of the inverter circuit 11 or may be used just to indicate the open state.

Furthermore, since the liquid crystal display apparatus detects a voltage rather than a current, the first and second voltage detection elements, e.g., capacitors may be adopted to achieve size reduction and cost reduction of the product.

In the multiplication circuits 33, 36 shown in FIG. 2, the peak value Vb is multiplied by the constant ½, but the constant can be decided arbitrarily. For instance, the constant may be 0.6, 0.4, or 0.2. In the multiplication circuits 33, 36, alternatively, what is multiplied by the constant may be the average value Va instead of the peak value Vb.

In the discharge lamp drive apparatus, alternatively, the peak value Vb or the average value Va may be adjusted by an addition circuit, a subtraction circuit, or a division circuit, in place of the multiplication circuit.

Figure 7:
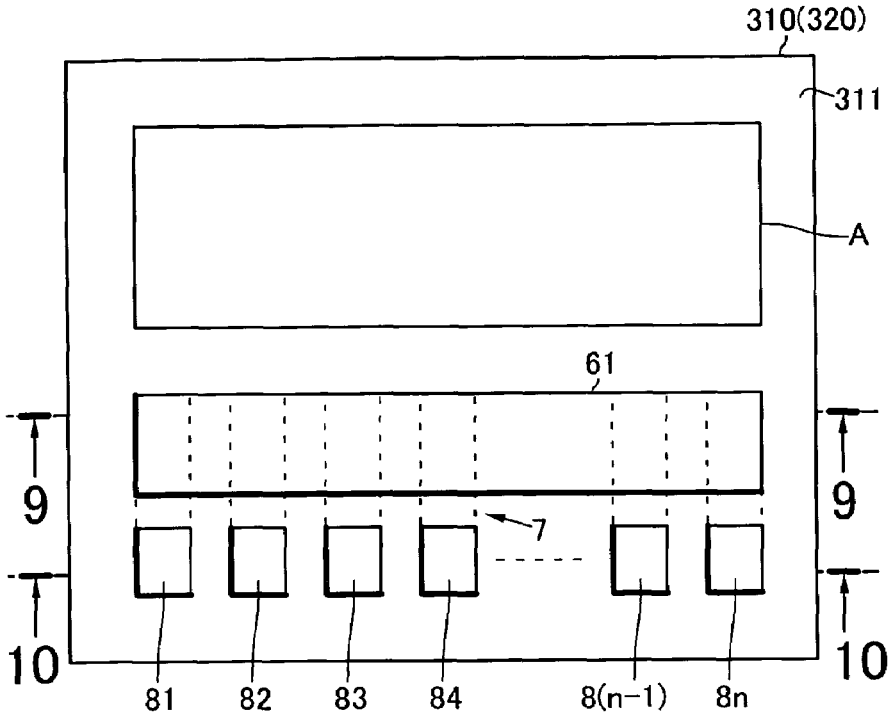
FIG. 7 is a top view of a substrate for use in the discharge lamp drive apparatus shown in FIG. 1.
Figure 8:
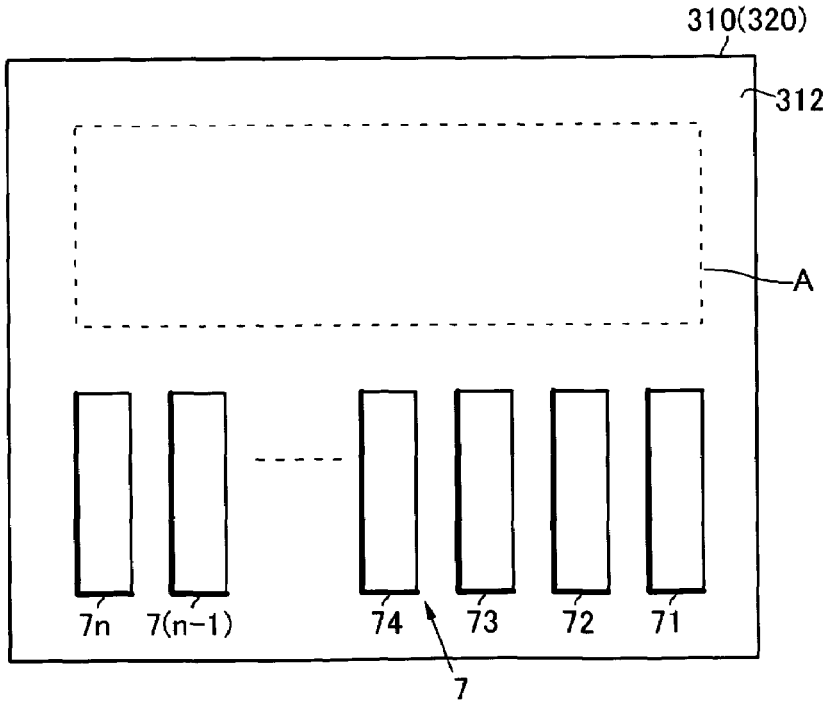
FIG. 8 is a bottom view of the substrate shown in FIG. 7.
Figure 9:
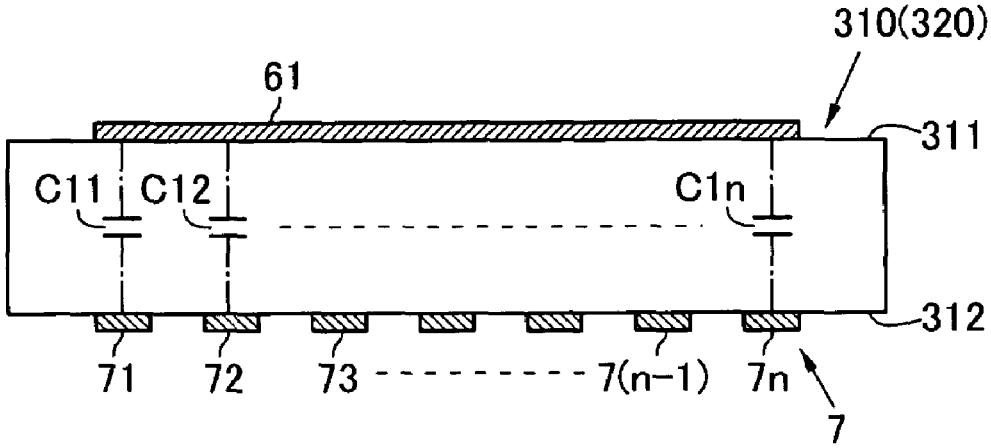
FIG. 9 is a sectional view taken along line 9-9 of FIG. 7.
Figure 10:
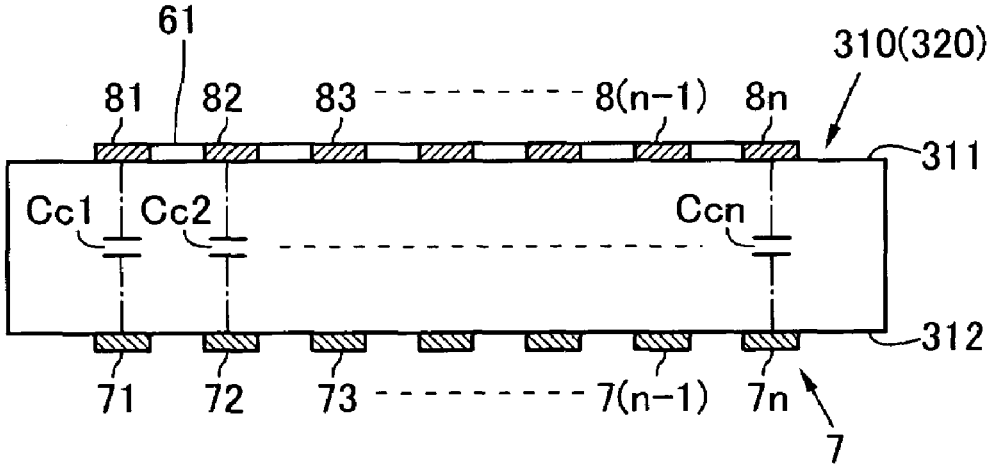
FIG. 10 is a sectional view taken along line 10-10 of FIG. 7.

The capacitors constituting the ballast capacitors and the voltage detection elements may be formed on a substrate by using the dielectric constant of the substrate rather than using chip parts, as shown in FIGS. 7 to 10. FIG. 7 is a top view of a substrate which may be used in the discharge lamp drive apparatus shown in FIG. 1, FIG. 8 is a bottom view of the substrate shown in FIG. 7, FIG. 9 is a sectional view taken along line 9-9 of FIG. 7, and FIG. 10 is a sectional view taken along line 10-10 of FIG. 7.

Referring to FIGS. 7 to 10, the first substrate 310 has opposite first and second sides 311, 312. On the first side 311, for instance, the inverter circuit 11 and the first transformer T11 are mounted on a component mounting part A. A pattern 61 is the first electrode of the first ballast capacitors C11 to C1*n*, while patterns 81 to 8*n* are the second electrodes of the first voltage detection elements Cc1 to Ccn.

On the second side 312, there is provided a pattern group 7 consisting of patterns 71 to 7*n*. The patterns 71 to 7*n* are the second electrodes of the first ballast capacitors C11 to C1*n*, which are integrally formed with the first electrodes of the first voltage detection elements Cc1 to Ccn, respectively.

In the illustrated configuration, assuming that an electrode area of the first voltage detection elements is S1, a thickness of the first substrate 310 is d1, the electric constant is $e_0$, and a relative permittivity of the first substrate 310 is $e_r$, the capacitance of the first voltage detection elements Cc1 to Ccn can be expressed as follows:

$$Cc1 \text{ to } Ccn=(e_0 e_r S1)/d1.$$

Likewise, assuming that an electrode area of the first ballast capacitors is S2, the capacitance of the first ballast capacitors C11 to C1*n* can be expressed as follows:

$$C11 \text{ to } C1n=(e_0 e_r S2)/d1.$$

The second substrate 320 has the same configuration as the first substrate 310. Specifically, the second transformer T21 is mounted on the component mounting part A, and the pattern 61 is the first electrode of the second ballast capacitors C21 to C2*n*. The patterns 81 to 8*n* are the second electrodes of the first voltage detection elements Ce1 to Cen. The patterns 71 to 7*n* are the second electrodes of the second ballast capacitors C21 to C2*n*, which are integrally formed with the first electrodes of the first voltage detection elements Ce1 to Cen, respectively.

In the illustrated embodiment, since the first voltage detection elements Cc1 to Ccn and the ballast capacitors C11 to C1*n* are formed on the same substrate 310, size reduction and cost reduction can be achieved. This is also true for the substrate 320.

In addition, since the second electrodes of the first ballast capacitors are integrated with the first electrodes of the first voltage detection elements to provide the patterns 71 to 7*n*, size reduction and cost reduction can be achieved.

Figure 11:
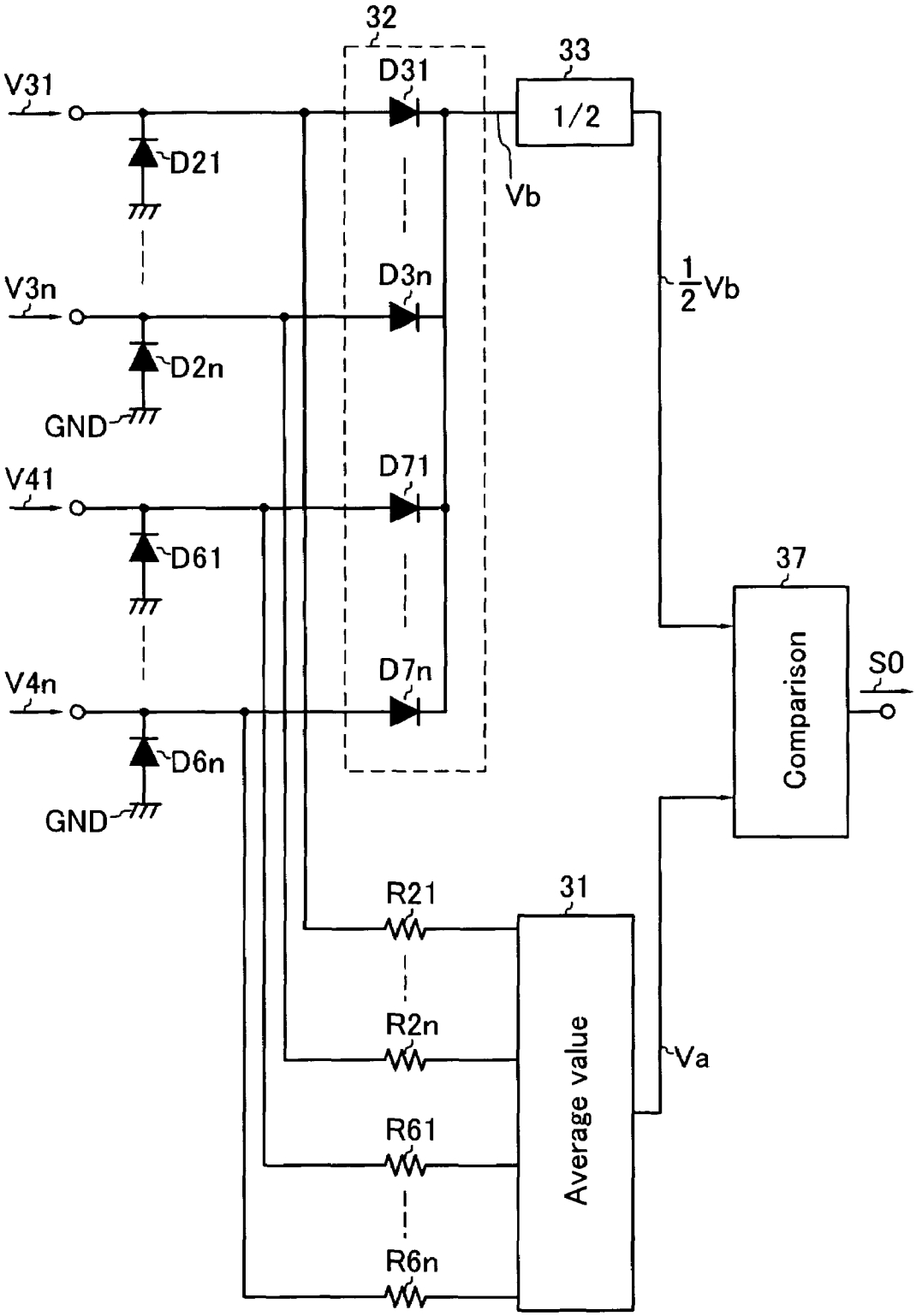
FIG. 11 is an electric circuit diagram showing a signal processor for use in a discharge lamp drive apparatus according to another embodiment of the present invention.
Figure 12:
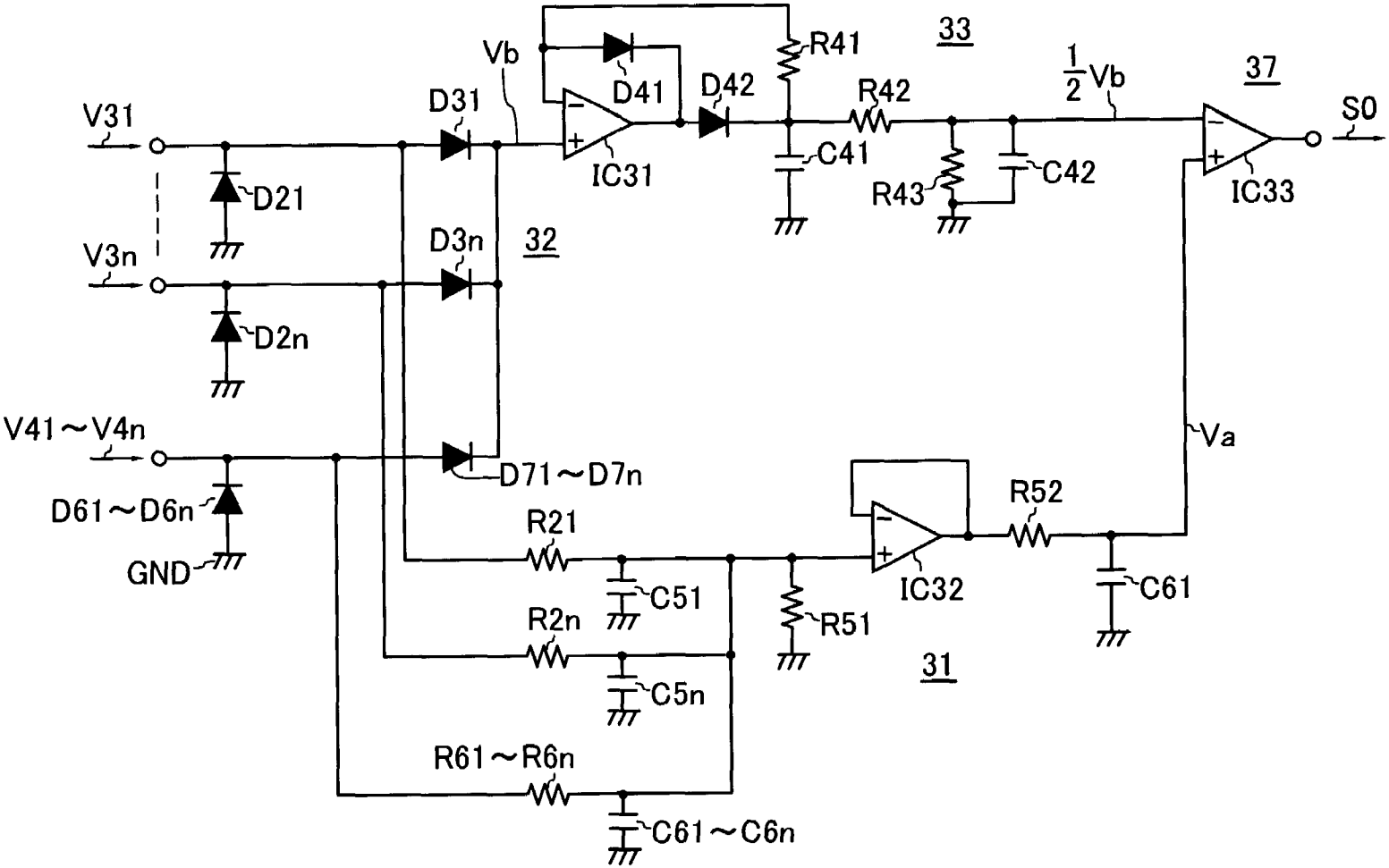
FIG. 12 is a more detailed electric circuit diagram showing the signal processor of FIG. 11.

FIG. 11 is an electric circuit diagram showing a signal processor for use in a discharge lamp drive apparatus according to another embodiment of the present invention, and FIG. 12 is a more detailed electric circuit diagram showing the signal processor of FIG. 11. In these drawings, the portions identical to the elements shown in FIGS. 1 to 6 are designated by the same reference numerals, and a duplicate description will be omitted.

In FIGS. 11 and 12, the average value circuit 31 of the signal processor 30 averages the individual voltages V31 to V3*n*, V41 to V4*n* to obtain an average value Va. The peak detection circuit 32 detects a maximum peak value among the voltages V31 to V3*n*, V41 to V4*n* to obtain a peak value Vb. The multiplication circuit 33 multiplies the peak value Vb by the constant ½ to obtain (½)Vb.

The comparison circuit 37 generates the signal S0 indicating an open state of a discharge lamp when the following inequality is satisfied:

$$Va<(1/2)Vb.$$

The discharge lamp drive apparatus adopting the signal processor shown in FIGS. 11 and 12 has the same effects and advantages as the discharge lamp drive apparatus shown in FIGS. 1 to 6.

In addition, since the signal processor shown in FIGS. 11 and 12 requires only a single group of the average value circuit 31, the peak detection circuit 32 and the multiplication circuit 33 to detect an open state at the first or second electrodes of the discharge lamps 21 to 2*n*, the number of elements may be decreased to achieve size reduction and cost reduction of the product.

In a discharge lamp drive apparatus according to still another embodiment of the present invention, the first electrodes of the first voltage detection elements may be connected only with either the first discharge lamp connection terminals P11 to P1*n* or the second discharge lamp connection terminals P21 to P2*n*. This is because when one electrode of a discharge lamp enters an open state, the other electrode often enters an open state at the same time. When both the electrodes enter an open state at the same time, the voltage characteristics change at both the first discharge lamp connection terminals P11 to P1*n* and the second discharge lamp connection terminals P21 to P2*n*.

It should be noted that the discharge lamp drive apparatus according to the present invention is not limited to the differential drive scheme (or floating scheme), but is also applicable to the normal drive scheme.

While the present invention has been particularly shown and described with reference to embodiments thereof, it will be understood by those skilled in the art that various changes in form and detail may be made therein without departing from the spirit, scope and teaching of the invention.

What is claimed is:

1. A discharge lamp drive apparatus comprising:

an inverter circuit converting a direct-current voltage into an alternating voltage and outputting the converted voltage;

a transformer receiving the alternating voltage from said inverter circuit at an input winding thereof and outputting an alternating voltage from an output winding thereof;

a plurality of discharge lamp connection terminals to be connected with a plurality of discharge lamps, respectively;

a plurality of ballast capacitors each having a first electrode led to the output winding and a second electrode connected with a corresponding one of said discharge lamp connection terminals;

a plurality of voltage detection circuits each having first and second voltage detection elements constituting a series circuit, each series circuit having a first end connected with a corresponding one of said discharge lamp connection terminals and a second end connected with a grounding terminal; and a signal processor generating a signal indicating an open state of a discharge lamp by using an average value and a peak value of voltages appearing between connection points of the first and second voltage detection elements and the grounding terminals.

2. The discharge lamp drive apparatus of claim 1, wherein the first and second voltage detection elements are capacitors.

3. The discharge lamp drive apparatus of claim 1, wherein said signal processor generates the signal indicating an open state of a discharge lamp when the following inequality is satisfied:

$$Va<(1/2)Vb$$

where Va represents an average value of the voltages appearing between connection points of the first and second voltage detection elements and the grounding terminals, and Vb represents a peak value of the voltages appearing between connection points of the first and second voltage detection elements and the grounding terminals.

4. The discharge lamp drive apparatus of claim 1, wherein said transformer includes first and second transformers, said ballast capacitors include a plurality of first ballast capacitors and a plurality of second ballast capacitors, and said discharge lamp connection terminals include a plurality of first discharge lamp connection terminals and a plurality of second discharge lamp connection terminals, wherein each first ballast capacitor has a first electrode led to an output winding of said first transformer and a second electrode connected with a corresponding one of said first discharge lamp connection terminals, each second ballast capacitor has a first electrode led to an output winding of said second transformer and a second electrode connected with a corresponding one of said second discharge lamp connection terminals, and the first end of each series circuit is connected with either of said first and second discharge lamp connection terminals.

5. A liquid crystal display apparatus comprising:

a discharge lamp drive apparatus;

a plurality of discharge lamps; and a liquid crystal panel disposed in front of said discharge lamps, wherein said discharge lamp drive apparatus includes:

an inverter circuit converting a direct-current voltage into an alternating voltage and outputting the converted voltage;

a transformer receiving the alternating voltage from said inverter circuit at an input winding thereof and outputting an alternating voltage from an output winding thereof;

a plurality of discharge lamp connection terminals connected with said plurality of discharge lamps, respectively;

a plurality of ballast capacitors each having a first electrode led to the output winding and a second electrode connected with a corresponding one of said discharge lamp connection terminals;

a plurality of voltage detection circuits each having first and second voltage detection elements constituting a series circuit, each series circuit having a first end connected with a corresponding one of said discharge lamp connection terminals and a second end connected with a grounding terminal; and a signal processor generating a signal indicating an open state of a discharge lamp by using an average value and a peak value of voltages appearing between connection points of the first and second voltage detection elements and the grounding terminals.

6. The liquid crystal display apparatus of claim 5, wherein the first and second voltage detection elements are capacitors.

7. The liquid crystal display apparatus of claim 5, wherein said signal processor generates the signal indicating an open state of a discharge lamp when the following inequality is satisfied:

$$Va<(1/2)Vb$$

where Va represents an average value of the voltages appearing between connection points of the first and second voltage detection elements and the grounding terminals, and Vb represents a peak value of the voltages appearing between connection points of the first and second voltage detection elements and the grounding terminals.

8. The liquid crystal display apparatus of claim 5, wherein said transformer includes first and second transformers, said ballast capacitors include a plurality of first ballast capacitors and a plurality of second ballast capacitors, and said discharge lamp connection terminals include a plurality of first discharge lamp connection terminals and a plurality of second discharge lamp connection terminals, wherein each first ballast capacitor has a first electrode led to an output winding of said first transformer and a second electrode connected with a corresponding one of said first discharge lamp connection terminals, each second ballast capacitor has a first electrode led to an output winding of said second transformer and a second electrode connected with a corresponding one of said second discharge lamp connection terminals, and the first end of each series circuit is connected with either of said first and second discharge lamp connection terminals.

* * * * *